US011626217B2

(12) United States Patent
Martins

(10) Patent No.: US 11,626,217 B2
(45) Date of Patent: Apr. 11, 2023

(54) METHOD AND DEVICE FOR PRODUCING A CABLE

(71) Applicant: LEONI BORDNETZ-SYSTEME GMBH, Kitzingen (DE)

(72) Inventor: Paulo Martins, Kitzingen (DE)

(73) Assignee: Leon Bordnetz-Systeme GmbH, Kitzingen (DE)

( * ) Notice: Subject to any disclaimer, the term of this patent is extended or adjusted under 35 U.S.C. 154(b) by 270 days.

(21) Appl. No.: 16/770,486

(22) PCT Filed: Dec. 6, 2018

(86) PCT No.: PCT/EP2018/083872

§ 371 (c)(1),
(2) Date: Jun. 5, 2020

(87) PCT Pub. No.: WO2019/110761

PCT Pub. Date: Jun. 13, 2019

(65) Prior Publication Data

US 2020/0388419 A1 Dec. 10, 2020

(30) Foreign Application Priority Data

Dec. 7, 2017 (DE) ..... 10 2017 222 107.0

(51) Int. Cl.
*H01B 13/02* (2006.01)
*D07B 3/08* (2006.01)
*H01B 11/02* (2006.01)

(52) U.S. Cl.
CPC ..... *H01B 13/02* (2013.01); *D07B 3/08* (2013.01); *H01B 11/02* (2013.01); *H01B 13/0214* (2013.01); *D07B 2207/4004* (2013.01); *D07B 2207/4018* (2013.01); *D07B 2501/406* (2013.01)

(58) Field of Classification Search
CPC ..... D07B 3/08; D07B 2207/4004; D07B 2207/4018; D07B 2501/406; H01B 13/0214
USPC ..... 140/111, 149; 57/66, 71
See application file for complete search history.

(56) References Cited

U.S. PATENT DOCUMENTS 3,370,622 A * 2/1968 Marks ..... B21F 7/00 72/145
3,884,024 A 5/1975 Oestreich et al.
3,969,880 A * 7/1976 Maillefer ..... D07B 7/02 57/352
4,214,430 A * 7/1980 Vogelsberg ..... D07B 3/005 57/293

(Continued)

FOREIGN PATENT DOCUMENTS

DE 74 40 528 U 11/1976
DE 28 33 699 A1 2/1980

(Continued)

*Primary Examiner* — Khoa D Huynh
*Assistant Examiner* — Grace Huang
(74) *Attorney, Agent, or Firm* — Muncy, Geissler, Olds & Lowe, P.C.

(57) ABSTRACT

A method and a device for producing a twisted line comprising at least two wires. The at least two wires are unwound from at least one take-off spool and are twisted in a twisting unit to form the twisted line, wherein the twisting unit has a first roller and a second roller and the at least two wires are supplied to a twisting area between the two rollers and are twisted by turning the rollers in the same direction.

13 Claims, 2 Drawing Sheets

(56) References Cited

U.S. PATENT DOCUMENTS 4,384,447 A * 5/1983 Faulstich ..... D07B 3/04 57/58.83
4,443,277 A * 4/1984 Rokas ..... H01B 13/10 428/377
4,590,752 A * 5/1986 Aubert ..... B65H 81/08 140/71 C
4,726,180 A * 2/1988 Naylor ..... D02G 1/06 57/284
4,727,716 A * 3/1988 Billner ..... D01H 4/16 57/401
4,901,518 A * 2/1990 Stalder ..... D01H 4/18 57/415
5,243,813 A * 9/1993 Stahlecker ..... D01H 1/115 57/328
5,689,945 A * 11/1997 Tobler ..... D01H 5/74 57/328
5,897,680 A * 4/1999 Geertman ..... G02B 6/02285 65/402
5,899,056 A * 5/1999 Stahlecker ..... D01H 4/16 57/332
5,927,062 A * 7/1999 Deno ..... D01H 1/115 57/328
8,484,841 B1 * 7/2013 Burros ..... D07B 1/147 29/877
8,556,041 B2 * 10/2013 Mustalahti ..... D07B 1/0673 254/390
2010/0133046 A1 * 6/2010 Allwardt ..... B66B 7/123 187/251
2015/0008011 A1 1/2015 Koeppendoerfer et al.
2016/0343471 A1 * 11/2016 Ernst ..... H01B 13/0214

FOREIGN PATENT DOCUMENTS

DE 2833699 A1 * 2/1980 ..... H01B 13/04
DE 198 47 958 A1 5/2000
DE 10 2014 201 992 A1 8/2015
EP 0 017 177 A1 10/1980
GB 190911083 A * 5/1910 ..... D07B 3/08
JP S6091508 A 5/1985
JP 61063728 A * 4/1986 ..... D01H 4/16
JP 2007-227185 A 9/2007
JP 2015225718 A 12/2015
WO WO 2013/139452 A1 9/2013
WO WO 2016/035779 A1 3/2016
WO WO-2016035779 A1 * 3/2016 ..... D07B 3/00

* cited by examiner

METHOD AND DEVICE FOR PRODUCING A CABLE

This nonprovisional application is a National Stage of International Application No. PCT/EP2018/083872, which was filed on Dec. 6, 2018, and which claims priority to German Patent Application No. 10 2017 222 107.0, which was filed in Germany on Dec. 7, 2017, and which are both herein incorporated by reference.

BACKGROUND OF THE INVENTION

Field of the Invention

The invention relates to a method and a device for producing a line.

Description of the Background Art

Nowadays, twisted lines are often used for many technical applications, especially for data lines. Twisted lines are lines that have twisted wires. The wires themselves are insulated conductors. The conductor often has a stranded conductor or a conductor wire. However, twisted lines often do not necessarily have a cable sheath that surrounds the wires. Such an additional cable sheath serves as a protective sheath against external influences, for example as mechanical, chemical and/or UV protection. Furthermore, twisted lines often—but also not necessarily—have a shielding against any electromagnetic influences that may occur. As an alternative to this, so-called unshielded twisted pair lines (UTP lines) are used, which have no shielding and achieve shielding against electromagnetic influences due to precise twisting.

In addition, twisted lines are known, which are coated, for example, with a protective lacquer instead of the cable sheath to reduce the cross section. For example, DE 10 2014 201 992 A1 shows an electrical line consisting of at least two individual wires, which has an adhesive layer applied in the form of a ring. The adhesive layer is designed as a reactive coating, so that when activated, a cohesive fixation takes place while simultaneously forming a protective jacket for the individual wires. The adhesive layer thus replaces the outer sheath.

WO 2013/139452 A1 also shows a variation in the lay length of twisted individual wires for high-frequency signal transmissions. This reduces the crosstalk effect.

So-called stranding devices are usually used to produce such a twisted line. Twisted lines are also referred to as stranded cables.

Such a stranding device is known from DE 74 40 528 U. The single wires to be stranded can be fed to a stranding head on unwinding spools.

Stranding devices are often complex.

SUMMARY OF THE INVENTION

Based on this, the object of the invention is to specify a method and a device with the aid of which twisted lines can be easily produced.

The object is achieved according to the invention by a method for producing a twisted line. Advantageous embodiments, developments and variants are the subject of the dependent claims.

The method is used to produce a twisted line with at least two wires. In the present case, wires are understood to mean, in particular, individual conductors, for example stranded conductors, which are surrounded by an insulation made of an insulating plastic. In the present case, twisting is understood to mean specifically twisting (wrapping) around a twisting axis of at least two wires. The twist axis is oriented in a production direction. The production direction is further defined by the direction (longitudinal line direction) along which the wires or the twisted line extend within a device for twisting.

The wires are unwound from at least one take-off spool, subsequently fed to a twisting unit and twisted by this into a line. Alternatively, each individual wire is unwound from its own take-off spool. For this purpose, the twisting unit has a first roller and a second roller. The rollers in each case rotate about an axis of rotation. The axis of rotation of the first roller and the axis of rotation of the second roller are oriented along the direction of production. Here along the production direction is understood to mean that the axes of rotation either run parallel to the production direction or at least within a plane which is defined also by the production direction. The at least two wires are fed to an intermediate area, referred to herein as the twisting area, between the two rollers. Due to the rotation of the rollers, the wires are twisted within the twisting area. In other words, the first roller and the second roller rotate in the same sense, i.e. in the same direction, for example clockwise.

As a result, the rotational movements of the rollers in the twisting area between the rollers are opposite. The advantage is that the twisting of the wires is simplified. For example, in the case of a twisting of two wires, one wire is guided in one direction of rotation and the other wire in the opposite direction of rotation.

Furthermore, the surfaces of the two rollers preferably have a material which has a high coefficient of static friction, for example rubber. This simplifies and optimizes the twisting of the wires due to the better adhesion to the rollers.

The twisting area between the two rollers is dimensioned in such a way that the conductor wires can be fed in, but they are grasped by the two rollers. Especially, the rollers are arranged one above the other, for example. Likewise, the wires, arranged one above the other, are fed to the twisting area. In other words: When the at least two wires are fed in, an upper wire is gripped by the "top" first roller and, analogously, a lower wire is gripped by the "bottom" second roller and carried along in the respective rotational movement.

As a result, the wires experience mutual displacement and are thus stranded in the direction of production. The advantage of this configuration is the simple and inexpensive manufacture of a twisted line, since there is no need for complex and/or complicated stranding devices.

According to a preferred embodiment, the first roller has a conical shape. In the present case, a conical shape is understood to mean that the value of a diameter of the first roller, viewed in the production direction, increases continuously and steadily. The second roller has a shape like a cylinder, for example, so that it has the same diameter over its length. This configuration increases the peripheral speed of the first, conical roller with increasing diameter, which results in a greater twisting of the wires. The twisting of the wires is correlated with a lay length of the twisted line. In the present case, lay length (often also referred to as pitch) is understood to mean a length along a twist axis which has a line core until it has wrapped (twisted) a full turn (from 360°) around the twist axis from an initial position. A stronger twist therefore results in a shortening of the lay length.

In other words, the twist is inversely proportional to the lay length. By means of the conically shaped roller, shorter lay lengths are achieved with less space requirement and a less complex device in comparison to conventional stranding devices. The shorter the lay length of a line, the greater the cohesion of the wires, which, in reverse, leads to greater stability and greater "untwist" security.

In a preferred embodiment the lay length of the twisted line is set by a longitudinal displacement of at least one of the two rollers, preferably the second roller. In the present case, longitudinal displaceability is understood to mean that, for example, the second roller is displaced in or against the production direction. By this it is in particular possible that different lines with different lay lengths are manufactured by means of a single twisting unit.

This is based on the consideration that the lay length is determined by an end of the roller. In the present case, the end of the roller is understood to mean specifically a point at which—viewed in the production direction—the twisting area between the two rollers ends. The end of the roller end therefore defines a twist point at which the lay length is determined. By shifting the rollers, this twist point is shifted along the conical roller, so that different lay lengths due to a different circumferential speed of the first, conical roller are set at the twist point.

After unwinding from the at least one take-off spool, the wires are guided through a feed unit. The feed unit preferably has a base body extending longitudinally in the production direction with a number of feed channels. The wires are each routed separately through a feed channel in which, for example, vibrations that occur during unwinding are dampened before they subsequently reach the twisting area of the twisting unit for twisting are supplied. The feed unit also ensures that the wires are not twisted in itself or that they are not already tangled with one another during unwinding.

Following the twisting, the twisted wires are fixed to one another in accordance with a preferred embodiment. According to an preferred further development, the twisted line is guided after the twisting unit through a fixing unit, so that the wires are fixed, in particular glued, by a material bond. The fixing unit is preferably designed as a heating furnace in which the wires of the twisted line are glued. For this purpose, the line cores have, for example, a coating which can be activated by heat, which is activated when passing through the fixing unit and the line cores are thus adhesively bonded. For example, the wires are fixed to one another in a manner already known from DE 10 2014 201 992 A1.

As an alternative or in addition, a fixing medium, for example an adhesive or a varnish, is applied to the twisted line within the fixing unit, which, for example, can be activated either by heat and/or by UV light and fixes the wires together during hardening.

In order to simplify the unwinding of the wires, the take-off spools rotate. For this purpose, the take-off spools are arranged, for example, on rotating plates.

The twisted line is preferably designed as an unshielded twisted pair line (UTP line). The finished, twisted line therefore has no shielding and preferably also no jacket. UTP lines have proven to be particularly suitable in the area of data lines, especially in the low-cost area. Such UTP lines are used for example in the automotive field. Alternatively, twisted lines are produced using the method described, which have up to 6 wires.

The method is preferably designed as an endless method. In the present case, endless processes are generally understood to mean a production process for strand-like elements. In the present case, a method is specifically understood in which the twisted line, after being fixed by the fixing unit, is wound up, for example, on a transport spool. The twisted line is thus manufactured according to common understanding, for example as yard ware. Contrary to the actual meaning, the term endless is thus defined here as the length of the twisted line, which corresponds to a maximum length of twisted line that can be wound onto a transport spool.

The twisted wires are preferably drawn off by means of a drawing unit arranged downstream of the twisting unit when viewed in the direction of production, and are preferably subsequently wound onto a transport spool. The advantage of this configuration is that, regardless of their number, the wires are wound from the take-off spools only by means of a single drawing unit, since the twisted line is pulled at the end when viewed in the direction of production.

The object is further achieved according to the invention by a device for producing a twisted line. The device is designed in particular for producing a twisted line using the method already described.

For this purpose, the device has at least one take-off spool for unwinding at least two wires. Furthermore, the device has a twisting unit to which the at least two wires can be fed.

For twisting the at least two wires, the twisting unit has a first roller rotating about a first axis of rotation and a second roller rotating about a second axis of rotation. The first roller and the second roller are arranged side by side and each run along the direction of production. Furthermore, the two rollers have a twisting area between them, to which the at least two wires can be fed for twisting. Furthermore, the rollers are designed for rotation in the same direction. The device therefore has, in particular, a control device for controlling the rollers, which is designed such that the two rollers rotate in the same direction during operation.

The first roller preferably has a conical shape in particular, the value of a diameter of the first roller viewed in the direction of production increasing continuously and steadily. The second roller has a shape like a cylinder.

At least the second roller is preferably displaceable in and against the production direction for setting a lay length of the twisted line.

The advantages and preferred configurations listed with regard to the method are to be applied analogously to the device and the twisting unit and vice versa.

Exemplary embodiments of the invention are explained in more detail below with reference to the figures.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
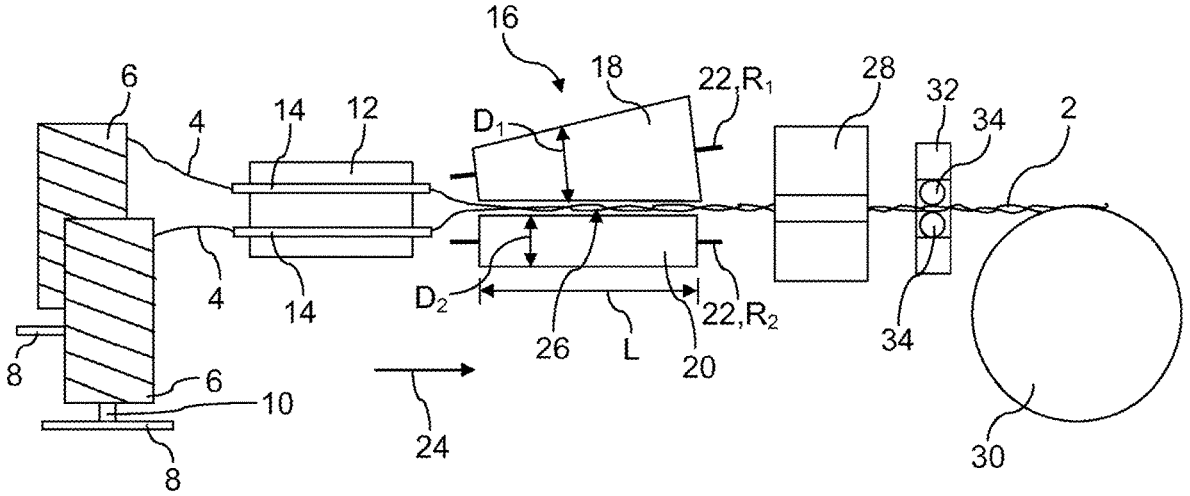
FIG. 1 shows a device for producing a twisted line.

FIG. 1 shows a roughly outlined block diagram of the method. For better understanding, the method is explained below using a device provided for this purpose. The explanations and descriptions thus provide a more detailed understanding of the process.

In the embodiment according to FIG. 1, the method steps for producing a twisted line 2 from two wires 4 are shown. The wires 4 are wound on take-off spools 6 in order to ensure space-saving storage on the one hand and easy transport of the wires 4 on the other. The wires 4 are unwound from the take-off spools 6. In order to facilitate unwinding, the take-off spools 6 are rotatably mounted. In the exemplary embodiment, the take-off spools 6 are arranged on rotary tables 8 which, for example, form a rotatable arrangement by means of rotating elements 10. In the present case, rotary element 10 is understood to mean, for example, a shaft that can be rotated about an axis of rotation and/or a rotary bearing. In particular, the take-off spools 6 are rotatably supported passively, i.e. they are not actively driven, for example by means of a motor.

After unwinding from the take-off spools 6, the wires 4 are passed into a feed unit 12. In the feed unit 12, the wires 4 are separated and passed through a feed channel 14, in which they experience a calming. Calming is understood here to mean that vibrations of the wires 4 which occur, for example, as a result of unwinding, are damped in the feed channel 14. For this purpose, the feed channel 14 has a diameter which is, for example, only 1 mm to 5 mm larger than the diameter of the wires 4. In this way, it is achieved that vibrating wires 4 strike an inner wall of the feed channel 14 and are thereby damped.

After passing through the feed unit 12, the wires 4 are fed to a twisting unit 16. In the shown embodiment, the twisting unit 16 has a first roller 18 and a second roller 20, which are usually arranged in a housing (not shown here). The two rollers 18, 20 are each rotatably supported by means of a rotary shaft 22 and each rotate about an axis of rotation R1, R2, which corresponds to the respective rotary shaft 22. The rollers 18, 20 are arranged along a longitudinal or production direction 24. In the present case, production direction 24 is understood to mean specifically a direction along which the wires 4 and the twisted line 2 extend within the twisting device, that is to say within the area between the feed unit 12 and an area after the twisting unit 16. The individual method steps from the wires 4 to the twisted line 2 are carried out along the production direction 24.

The first roller 18 has a conical shape. In the exemplary embodiment, the conical shape of the first roller 18 is designed such that a diameter D1 of the first roller 18 viewed in the direction of production 24 has a steady and continuously increasing value. In other words: viewed in the direction of production 24, the first roller 18 thickens. The second roller 20 has a shape in the manner of a cylinder, i.e., a diameter D2 of the second roller 20 has a constant value along a length L of the second roller 20 and viewed in the direction of production 24. Due to the conical configuration, the first axis of rotation R1 is inclined, for example by an angle in the range from 10° to 30° to the direction of production 24 and also to the second axis of rotation R2, which runs parallel to the direction of production 24. The production direction 24 and the two axes of rotation R1, R2 are arranged within a common plane, which according to FIG. 1 is spanned by the paper plane.

The lateral surfaces of the two rollers 18, 20 run parallel to one another in the region in which they lie opposite one another and thus also parallel to the direction of production 24.

Both rollers 18, 20 are therefore aligned in and along the production direction 24 and thus in the direction of the lines 4 or the twisted line 2. This means that the rollers 18, 20 have a longitudinal extension that is oriented in the direction of production 24. The respective axis of rotation R1, R2 of the rollers 18, 20 runs parallel to the production direction 24 and thus parallel to the wires 4 and the twisted line 2. At least one directional component of the respective axis of rotation R1, R2 runs parallel to the direction of production 24. This is understood to mean that the axis of rotation R1, R2 runs at least within a plane that is spanned by the production direction 24 and a further direction. The axis of rotation R1, R2 can therefore also be inclined at an angle to the direction of production 24. Under parallel it is understood therefore an exactly parallel orientation or a mostly parallel orientation for example with deviations of a maximum of +/31 20°, preferably of a maximum of +/−10° and further preferably of a maximum of +/−5° from the exact parallel orientation.

In this respect, the two rollers 18, 20 are thus arranged along or in the direction of the production direction 24 in the embodiment. A twisting area 26 is formed between them, into which the wires 4 are introduced for twisting. In the embodiment, the rollers 18, 20 rotate in the same direction for example clockwise. As a result, the rotational movements of the rollers 18, 20 are directed in opposite directions in the twisting area 26.

In the following, the twisting of the wires 4 to the line 2 within the twisting unit 16 is briefly discussed: When the wires 4 are introduced into the twisting area 26, the rollers 18, 20 in the shown embodiment each "capture" a wire line 4 and "takes" it along due to its movement. In other words: the first roller 18 rotates in the twisting area 26, for example, to the left (viewed in the direction of production 24). One of the line cores 4 is picked up by the first roller 18 when it is introduced and is guided to the left. Analogously to this, the second roller 20 rotates away to the right in the twisting area 26 and guides the other of the two wires 4 to the right. The wires 4 are thus twisted. By alternating this process and driving the wires 4 within the twisting unit 16, the twisted line 2 is generated. In order to optimize the twisting of the wires 4 by means of the rollers 18, 20, the surfaces of the rollers 18, 20 have a material with a high static friction. For example, the surfaces of the rollers 18, 20 are rubberized in the exemplary embodiment. Due to the increasing diameter D1 of the first roller 18, viewed in the direction of production 24, the circumferential speed of the first roller 18 increases in the direction of production 24.

The increase in the circumferential speed results in an increase in the twisting of the wires 4, which results in a shorter lay length of the twisted line 2. The shorter lay length has the advantage that the twisted line 2 is more resistant to a possible untwist and the wires 4 are thus twisted more tightly compared to a line which has a longer lay length. In particular, at least the second roller 20 can be displaced in and against a longitudinal direction. In the exemplary embodiment, the longitudinal direction corresponds to the production direction 24. The advantage of the longitudinal displacement of the at least second roller 20 can be seen in the production of twisted lines 2 with different lay lengths. This is discussed in more detail with respect to FIGS. 2 and 3.

After twisting the wires 4 in the twisting unit 16 to the line 2, the latter is passed into a fixing unit 28. In the fixing unit 28, the twisted wires 4 are fixed together, for example glued. For this purpose, for example, an adhesive is sprayed onto the twisted line 2 within the fixing unit 28 and cured, for example by means of heat. Alternatively, the wires 4 have an activatable coating, which is activated, for example, by heat and/or UV light when passing through the fixing unit 28, and irreversibly fixes the twisted wires 4 together.

After passing through the fixing unit 28, the twisted line 2 is wound on a transport spool 30 to simplify storage and transport.

In the exemplary embodiment, the described method is designed as a so-called endless method. This means that, in particular, no individual sections of the twisted line 2 are manufactured, but rather the twisted line 2 is produced in the manner of yard goods known in common parlance. In the present case, endless method is understood to mean a maximum holding capacity of the transport spool 30. Transport spool 30 of this type have, for example, a holding capacity for lines with a length in the range from 1000 m to 2000 m. The twisted line 2 produced by means of the described endless method thus serves in particular for subsequent assembly, for example at a wholesaler and/or a customer. Subsequently is to be understood here especially as a time after the production of the twisted line 2 . A drawing unit 32 is arranged between the twisting unit 16 and the transport spool 30 for winding onto the transport spool 30 and for unwinding from the take-off spools 6.

The twisted line 2 is guided through the drawing unit 32 and experiences a tensile force in it in the production direction 24. The tensile force acts, for example, by means of drawing rolls 34 arranged laterally on the twisted line 2.

Figure 2:
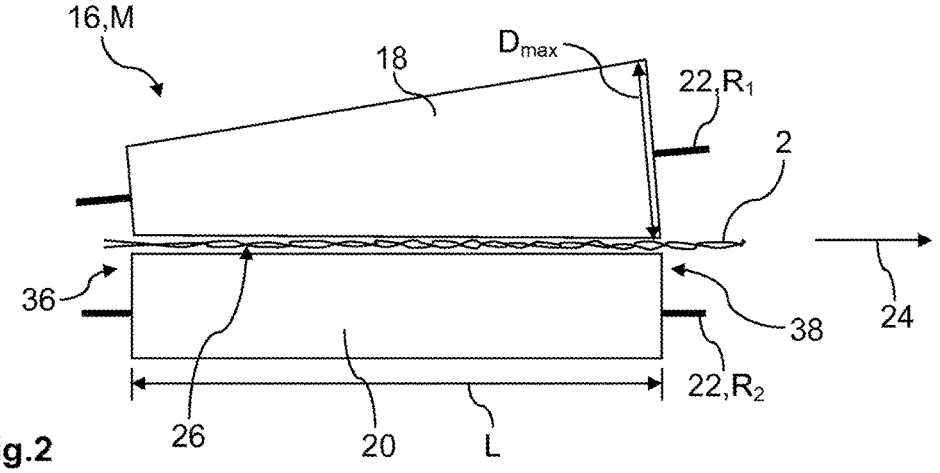
FIG. 2 shows a simplified side view of a twisting unit.

FIG. 2 shows a sketched side view of a twisting unit 16, in particular a first roller 18 and a second roller 20. The rollers 18, 20 in FIG. 2 are not displaced relative to one another in the production direction 24, so that they are each arranged flush with one another at a roller start 36 and a roller end 38. In particular, the conical shape of the first roller 18 increases the circumferential speed of the first roller 18. The higher circumferential speed also increases the twisting speed with which the wires 4 are stranded. The circumferential speed of the first roller 18, in particular, is correlated inversely proportional to the lay length, so that an increase in the circumferential speed results in a shortening of the lay length.

The lay length is determined in particular by the roller end 38, i.e., the wires 4 are twisted in the twisting area 26 until they are led out of the twisting unit 16 at the roller end 38. However, the wires 4 are only twisted if they are arranged between the two rollers 18, 20. In the exemplary embodiment in FIG. 2, the wires 4 are twisted over the entire length L of the second roller 20. A maximum diameter Dmax at the roller end 38 defines the peripheral speed and thus the twisting speed and the resulting lay length of the twisted line 2. For the sake of a more detailed description, the roller position according to FIG. 2 of the exemplary embodiment is also referred to in the present case as maximum position M, since in such a roller position the wires 4 are twisted to a maximum possible, with regard to the geometric properties of the rollers 18, 20. Due to the longitudinal displaceability in and against the production direction 24, the roller position according to FIG. 3 is also possible.

Figure 3:
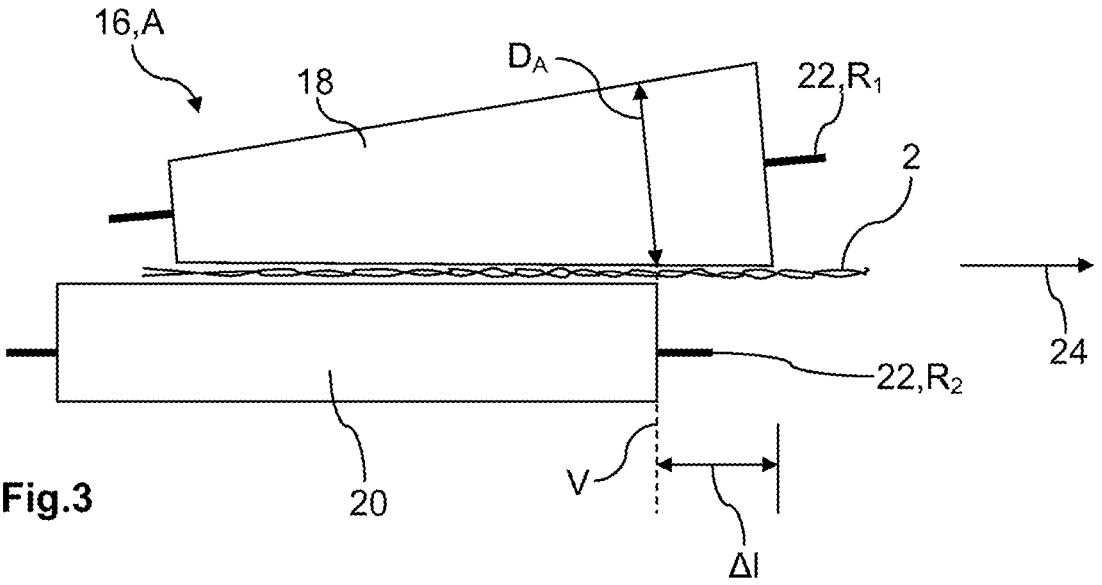
FIG. 3 shows a simplified side view of a twisting unit with shifted rollers.

FIG. 3 shows the second roller 20 displaced by a displacement ΔI from the maximum position and counter to the direction of production 24. The twisting area 26 in which the wires 4 are twisted is reduced in such a roller position—also referred to here as the displaced position A. Thus, in the embodiment according to FIG. 3, the diameter $D_{max}$ does not determine the peripheral speed and thus also the twisting speed. In FIG. 3, the twisting area 26 required for the twisting ends with a displacement by ΔI from the maximum position M. Thus, the diameter $D_A$ at this point S defines the peripheral speed and thus the twisting speed as well as the resulting lay length of the twisted line 2. Due to the fact that the diameter $D_A$ has a smaller value than the diameter Dmax, the peripheral speed at the point—also referred to as the twist point V—consequently also has a lower value than at the roller end 38.

This in turn leads to a longer lay length of the twisted line 2 in comparison to the twisted line 2 produced with the roller position M.

Alternatively, the first roller 18 can also be displaced in and counter to the production direction 24. Due to the configuration of the displaceability of the at least second roller 20 in the longitudinal direction, twisted lines 2 can be individually manufactured with regard to their lay lengths with only one twisting unit. The method described has the advantage that it can be used to manufacture such twisted lines in a simple and inexpensive manner.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

The invention claimed is:

1. A method for producing a twisted line with at least two wires, the at least two wires being unwound from at least one take-off spool and are twisted into the twisted line in a twisting unit, wherein the twisting unit has a first roller and a second roller and the at least two wires are fed to a twisting area between the first roller and the second roller and are twisted together in the twisting area between the first roller and the second roller by rotating the first roller and the second roller in a same direction as each other.

2. The method according to claim 1, wherein the first roller has a conical shape.

3. The method according to claim 1, wherein a length of lay of the twisted line is set by a longitudinal displacement of at least one roller of the first roller and the second roller.

4. The method according to claim 1, wherein the at least two wires, after unwinding and before twisting, are fed to a feed unit, wherein the at least two wires run separately through the feed unit.

5. The method according to claim 1, wherein the at least two wires are fixed after twisting.

6. The method according to claim 5, wherein after the twisting, the twisted line is guided through a fixing unit in which the at least two wires are glued together.

7. The method according to claim 1, wherein the at least one take-off spool rotates.

8. The method according to claim 1, wherein the twisted line is designed as a UTP line.

9. The method according to claim 1, wherein the method is designed as an endless method.

10. The method according to claim 1, wherein the twisted line is drawn off by a drawing unit arranged downstream of the twisting unit.

11. A device for producing a twisted line, the device extending along a production direction and comprising:

at least one take-off spool for unwinding at least two wires; and a twisting unit to which the at least two wires are fed, the twisting unit being arranged downstream of the at least one take-off spool in the direction of production, wherein the twisting unit has a first roller rotating about a first axis of rotation and second roller rotating about a second axis of rotation, wherein the first roller and the second roller extend along the production direction, are arranged next to one another and have a twisting area therebetween, wherein the at least two wires are fed to be twisted together in the twisting area into a twisted line, and wherein the production direction is a direction along which the twisted line extends.

12. The device according to claim 11, wherein the first roller has a conical shape and the second roller has a cylindrical shape.

13. The device according to claim 11, wherein at least the second roller is displaceable in and against the production direction for setting a lay length of the twisted line.

* * * * *